US006297475B2

(12) United States Patent
Jones

(10) Patent No.: US 6,297,475 B2
(45) Date of Patent: Oct. 2, 2001

(54) METHOD FOR PREVENTING ICE DAMS ON A ROOF

(75) Inventor: Thaddeus M. Jones, Bremen, IN (US)

(73) Assignee: MSX, Inc., South Bend, IN (US)

( * ) Notice: Subject to any disclaimer, the term of this patent is extended or adjusted under 35 U.S.C. 154(b) by 0 days.

(21) Appl. No.: 09/828,528

(22) Filed: Apr. 6, 2001

Related U.S. Application Data

(60) Division of application No. 09/342,493, filed on Apr. 3, 2000, now Pat. No. 6,219,102, which is a continuation-in-part of application No. 09/430,661, filed on Oct. 29, 1999, now Pat. No. 6,184,495.

(51) Int. Cl.[7] ..... H05B 1/00

(52) U.S. Cl. ..... 219/213; 219/497; 392/435

(58) Field of Search ..... 219/211, 212, 219/213, 217, 528, 536, 537, 526, 549, 539, 544, 548, 497; 392/435, 436, 437, 433; 338/306

(56) References Cited

U.S. PATENT DOCUMENTS

| | | | |
|---|---|---|---|
| 2,111,251 | 3/1938 | Spilsbury | 219/213 |
| 2,523,353 | 9/1950 | Boester | 392/435 |
| 3,095,491 | 6/1963 | Deacon | 219/213 |
| 3,191,004 | 6/1965 | Hocker | 392/435 |
| 3,277,273 | 10/1966 | Williams | 392/435 |
| 3,438,069 | 4/1969 | Long | 219/537 |
| 3,573,430 | 4/1971 | Eisler | 219/538 |
| 3,691,343 | 9/1972 | Norman | 219/213 |
| 3,716,076 * | 2/1973 | Franzmeier | 219/213 |
| 3,725,638 | 4/1973 | Solin et al. | 219/213 |
| 4,134,002 | 1/1979 | Stanford | 219/213 |
| 4,425,497 | 1/1984 | Leary et al. | 219/536 |
| 4,591,697 | 5/1986 | Lexer | 392/433 |
| 4,769,526 | 9/1988 | Taouil | 219/213 |
| 4,994,651 | 2/1991 | Jones | 219/497 |
| 5,315,090 | 5/1994 | Lowenthal | 219/213 |
| 5,391,858 | 2/1995 | Tourangeau et al. | 219/213 |
| 5,550,349 * | 8/1996 | Bomba | 219/213 |
| 5,573,685 * | 11/1996 | Boncaldo | 219/544 |
| 5,611,952 | 3/1997 | Jones | 219/497 |
| 5,619,613 | 4/1997 | Otaki | 392/437 |
| 5,710,408 * | 1/1998 | Jones | 219/549 |
| 5,763,858 * | 6/1998 | Jones | 219/213 |
| 5,878,533 | 3/1999 | Swanfeld, Jr. | 219/213 |
| 5,900,178 * | 5/1999 | Johnsen | 219/213 |
| 5,975,756 | 11/1999 | Jones | 219/544 |
| 6,057,531 | 5/2000 | Jones | 219/544 |
| 6,084,207 * | 7/2000 | Jones | 219/213 |
| 6,104,352 * | 8/2000 | Jones | 219/213 |
| 6,107,611 * | 8/2000 | Jones | 219/213 |
| 6,140,609 * | 10/2000 | Jones | 219/213 |

* cited by examiner

*Primary Examiner*—Teresa Walberg
*Assistant Examiner*—Fadi H. Dahbour
(74) *Attorney, Agent, or Firm*—Taylor & Aust, P.C.

(57) ABSTRACT

A method of preventing ice dams on an outside surface of a roof of a building includes placing a heating device below the roof. At least one of an ambient outside temperature and a presence of ambient moisture is sensed. An air-borne signal is transmitted dependent upon the sensing step. The heating device is operated dependent upon the air-borne signal.

11 Claims, 5 Drawing Sheets

METHOD FOR PREVENTING ICE DAMS ON A ROOF

CROSS-REFERENCE TO RELATED APPLICATIONS

This application is a division of U.S. patent application Ser. No. 09/542,493, entitled "HEATING APPARATUS FOR PREVENTING ICE DAMS ON A ROOF", filed on Apr. 3, 2000, now U.S. Pat. No. 6,219,102 which is a continuation-in-part of U.S. patent application Ser. No. 09/430,661, entitled "METHOD AND HEATING APPARATUS FOR PREVENTING ICE DAMS ON A ROOF", filed Oct. 29, 1999, now U.S. Pat. No. 6,184,495.

BACKGROUND OF THE INVENTION

1. Field of the Invention

The present invention relates to deicing systems, and, more particularly, to a roof and gutter deicing system.

2. Description of the Related Art

Ice dams forming near the outer edges, or "eaves," of a roof and extending into the gutters are a significant source of damage to a building. Ice dams form when snow on an inner or middle section of a roof melts and the meltwater flows down to the outer section of the roof, where it then refreezes into ice. The heat from within the building conducts through the roof to melt the snow on the middle portion of the roof. However, the outer edge of the roof extends outwardly beyond the outside wall of the building, and therefore is not heated by the heat from within the building. Thus, the melted snow from the middle portion of the roof refreezes and accumulates on the outer edge portion of the roof and in the gutters, thereby forming ice dams. Another possible cause of ice dams is the heating of the dark shingles when exposed to sunlight. Snow on the roof slides down to the gutter, where it abuts the gutter, thaws and refreezes. The freezing of the meltwater eventually builds up into an ice dam.

Such ice dams are known to cause leaks in roofs by allowing water to enter underneath the shingles of the roof and expand upon refreezing, thereby forcing the shingle away from the other shingles on the roof. The weight of ice dams can also tear a gutter away from the roof and/or soffit, thereby requiring costly repairs.

It is known to attach a heater wire to the outside surface of the outer edge portion of the roof. The heater wire may also extend along the gutter and through the downspout in order to maintain an open drainage path for melting of the frozen precipitation.

Snow and ice melting systems commonly employ automatic ON/OFF controls that operate heaters only while required to minimize energy consumption and operating costs. Typically, the automatic ON/OFF controls sense ambient moisture and temperature. However, it is also possible for the automatic ON/OFF control to be in the form of a thermostat which only senses ambient temperature. Heaters operate at ambient temperatures below a threshold—usually 38° F. while ambient moisture is present and for a period of time thereafter to clear accumulated snow and ice. Optionally, the automatic ON/OFF control may inhibit heater operation at temperatures too low for effective melting, e.g., below 17° F. Status indicators and a manual control and test switch are typically included in the same package with such automatic ON/OFF controls.

In order to reduce costs and simplify installation, it is known to install the automatic ON/OFF control package close to the heating device itself. A problem with installing the control package in close proximity to a roof heater is that it is then difficult to observe the status indicators and to test deicing system performance with the manual control and test switch.

Ground current is the difference between the outbound and return heater currents. The U.S. National Electric Code requires using a ground fault circuit interrupter (GFCI) on all snow and ice melting circuits. The GFCI interrupts heater current if the ground current exceeds a predetermined limit; usually 30 milliamperes. The GFCI requires manual reset after tripping. This preserves safety by not restarting heater operation during intermittent ground leakage current that may occur in wet locations.

Independent of the heater fabrication method, ground current can flow due to a heater failure caused by a manufacturing defect, corrosion, wear and tear or mechanical damage. Excessive ground current causes the dual safety problems of fire and shock hazard. An electrical shock hazard can also occur whenever ground current flows since its path to earth ground is usually not predictable. Thus, a GFCI is required to be incorporated into snow and ice melting electrical circuits. It is known to install a residential GFCI in a knockout box adjacent to the deicing system. Again, a problem is that a GFCI disposed next to a roof deicing system is difficult to access for purposes of resetting and/or testing the GFCI.

What is needed in the art is an apparatus for melting snow on the outer edge of a roof that does not require the user to physically access the apparatus in order to periodically reset or test the ground fault circuit interrupter or to monitor the status of the heater.

SUMMARY OF THE INVENTION

The present invention provides a heating apparatus including a ground fault circuit interrupter and a remote receiver for remotely resetting and testing the ground fault circuit interrupter and remotely monitoring the status of the heater.

The invention comprises, in one form thereof, a heating apparatus for preventing ice damns on an outside surface of a roof of a building. The heating apparatus includes a heating device placed below the roof. An automatic controller includes a ground fault circuit interrupter in communication with the heating device. The ground fault circuit interrupter detects a ground fault condition associated with the heating device. The controller selectively controls operation of the heating device dependent upon the ground fault condition. A transmitter is connected with the controller. The transmitter transmits an air-borne ground fault signal dependent upon the ground fault condition. A remote receiver receives the ground fault signal. The remote receiver provides at least one of a visible indication and an audible indication of the ground fault signal.

An advantage of the present invention is that a user does not need to physically access the heating apparatus in order to reset or test the ground fault circuit interrupter or to monitor the status of the heater.

Another advantage is that a single remote transceiver can be used to communicate with multiple heating devices and their controls.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
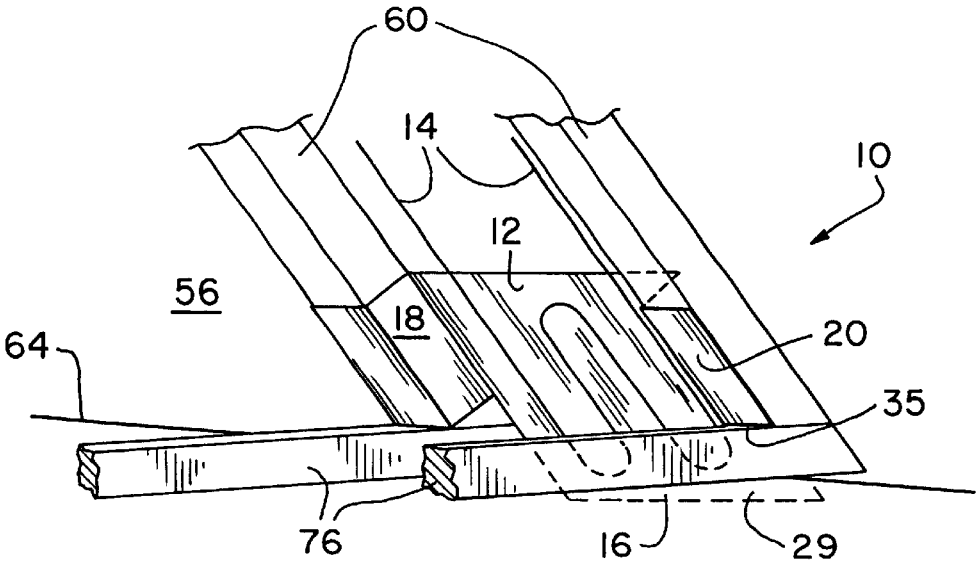
FIG. 1 is a perspective view of one embodiment of the snow melting apparatus of the present invention, mounted adjacent the inside surface of a roof.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to the drawings, and particularly to FIG. 1, there is shown a snow melting apparatus 10 including a heat conduction device 12 and a heater wire 14.

Heat conduction device 12 is formed monolithically of at least one sheet of thermally conductive material, such as aluminum. Heat conduction device 12 includes a planar body portion 6, two planar side portions 18 and two planar wings 20.

Figure 2:
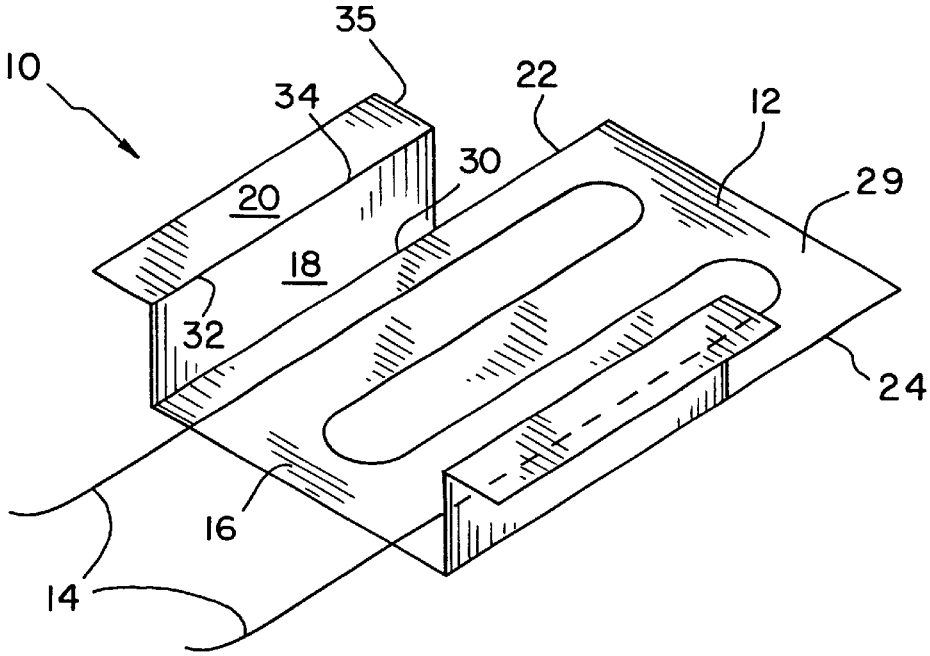
FIG. 2 is a perspective view of the snow melting apparatus of FIG. 1.
Figure 3:
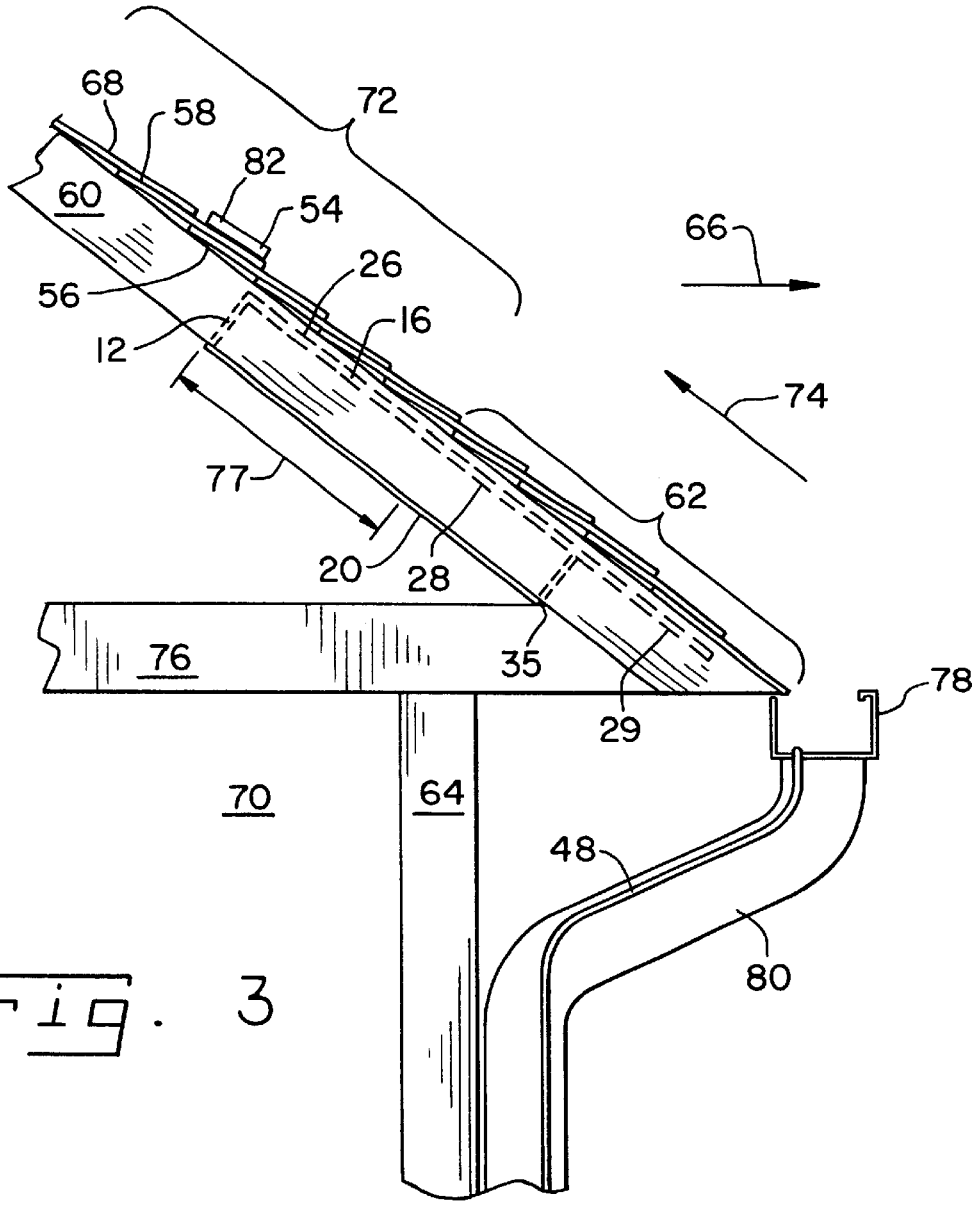
FIG. 3 is a cross-sectional view of another embodiment of the snow melting apparatus connected to a roof and to an associated gutter and downspout.

Body portion 16 has two opposite ends 22 and 24 (FIG. 2), a first side 26 (FIG. 3) and a second side 28. Side portions 18 extend perpendicularly from respective ends 22 and 24 of body portion 16 in a direction opposite or away from first side 26 of body portion 16. Body portion 16 has a distal part 29 which projects out from between side portions 18. Each side portion 18 has two opposite ends 30 and 32, with a first end 30 being attached to a respective one of ends 22 and 24 of body portion 16. Thus, heat conduction device 12 takes the shape of a "C-channel" heater.

Wings 20 extend perpendicularly and in opposite directions from respective ends 32 of respective side portions 18. A proximal end 34 of each wing 20 is attached to a respective end 32 of a respective side portion 18. Each wing 20 has a respective edge 35.

A first controller 36 (FIG. 4) selectively applies electrical current from a power supply 33 to heater wire 14. A receiver 40 connected to controller 36 can be used to receive an airborne signal, such as a radio frequency signal. The airborne signal, which is transmitted by a transmitter 42, indicates that operation of heater wire 14 is required, and that power from supply 38 should be applied thereto by controller 36. Antennas 44 and 46 are for receiving and transmitting, respectively, the airborne signal.

A second heater wire 48 has electrical current from a power supply 50 selectively applied thereto by a second controller 52. A sensor assembly 54 for sensing ambient precipitation and/or temperature is connected to controller 52.

Figure 5:
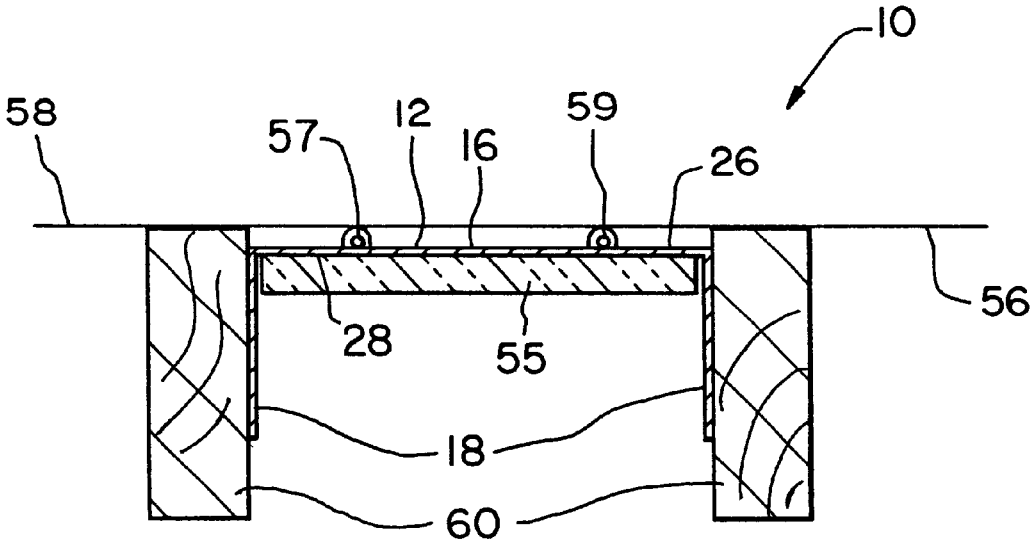
FIG. 5 is a&cross-sectional view of another embodiment of the snow melting apparatus connected to a roof.

In another embodiment (FIG. 5), a layer of thermal insulation 55 is attached to second side 28 of body portion 16. In FIG. 5, heater wire 14 is shown as being attached directly to inside surface 56 of roof 58. Heater wire 14 is also attached to first side 26 of body portion 16, rather than to second side 28, as in FIGS. 1 and 2. Heater wire 14 can be seen to include a central conductor 57 surrounded by a layer of electrical insulation 59, such as polyvinylchloride.

During manufacture, heat conduction device 12 can be cut from a sheet of thermally conductive material, such as aluminum. Side portions 18 can be formed by bending the sheet aluminum along ends 22 and 24. Similarly, wings 20 can be formed by again bending the sheet aluminum along ends 32 of side portions 18. Heater wire 14 includes a core electrical conductor surrounded by a layer of electrically insulating material. Heater wire 14 is then attached, such as by stapling or bonding, to first side 26 or second side 28 of body portion 16 in a serpentine pattern.

During installation, the assembly formed of heat conduction device 12 and heater wire 14 is mounted adjacent to an inside surface 56 of a roof 58. If roofing nails have been used to attach the shingles of roof 58, then a gap should be maintained between inside surface 56 and the assembly formed of heat conduction device 12 and heater wire 14 in order to avoid the roofing nails touching heater wire 14. If the shingles are attached in another way, such as by stapling, then the assembly formed of heat conduction device 12 and heater wire 14 can directly engage and be attached to inside surface 56 of roof 58. The width of body portion 16 between ends 22 and 24 is such that heat conduction device 12 fits snugly between two parallel rafters 60 which are attached to inside surface 56 of roof 58. Side portions 18 and/or wings 20 can be attached to respective rafters 60, such as by stapling or nailing.

An outer edge section 62 of roof 58 extends over and beyond an outside wall 64 in an outward, horizontal direction, indicated by arrow 66. Outer edge section 62 is particularly subject to having ice dams form on its outside surface 68 because outer edge section 62 is not exposed to the heat within building 70 which rises up to heat an inner section 72 of roof 58 and melt the snow thereon. Thus, the melted snow tends to refreeze when it reaches outer edge section 62, thereby forming ice dams.

For the above reasons, heat conduction device 12 is placed such that it can heat as much as possible of inside surface 56 of outer edge section 62. After being inserted between rafters 60, heat conduction device 12 is slid along rafters 60 in a downward and outward direction, opposite to a direction of incline 74 of roof 58, until edges 35 of wings 20 engage respective horizontal cross beams 76 of building 70. Heat conduction device 12 is oriented such that distal part 29 of body portion 16 extends over and beyond outside wall 64. In this installed position, a length 77 by which body portion 16 extends in direction 74 from outside wall 64 can be approximately 12 inches.

Figure 4:
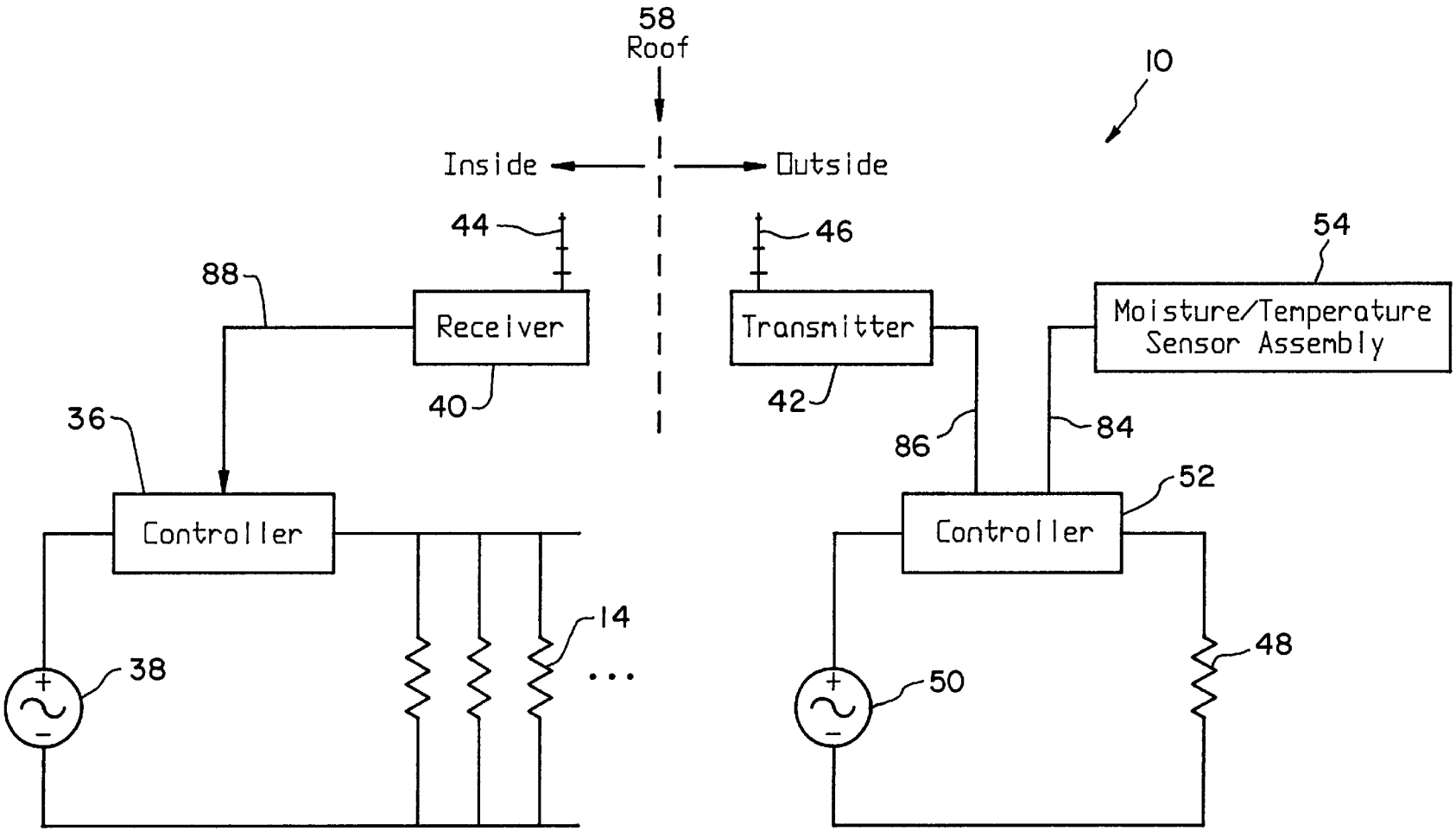
FIG. 4 is a schematic diagram of the snow melting apparatus of FIG. 3.

A separate heat conduction device 12 and associated heater wire 14 can be installed between each pair of parallel and adjacent rafters 60. As indicated in FIG. 4, heater wires 14 can be connected in parallel to power supply 38.

Heat wire 48 is placed in a gutter 78 and/or a downspout 80 attached to gutter 78. Controller 52, sensor assembly 54, transmitter 42 and antenna 46 can be all packaged in a common housing 82 which is installed on outside surface 68 of roof 58.

It is possible for sensor assembly 54 to include a plurality of moisture/temperature sensors installed at different locations on outside surface 68. Each of the sensors can be connected to a common controller 52 in an "or" configuration. That is, it is only necessary for one of the sensors to sense an ambient temperature below a predetermined level and/or the presence of ambient precipitation in order for controller 52 to call for heat from heaters 14 and 48.

During use, when sensor assembly 54 senses an ambient temperature below a predetermined level, such as 38° F., and/or the presence of ambient precipitation, a signal is transmitted to controller 52 on line(s) 84. Upon receiving this signal, controller 52 connects power supply 50 to heater wire 48, thereby causing heater wire 48 to dissipate heat. The heat is then conductively transferred to gutter 78 and/or downspout 80, ensuring a drainage path for any water within gutter 78. Controller 52 also transmits a signal on line 86 which, in turn, causes transmitter 42 to transmit an airborne signal from antenna 46. The airborne signal has a frequency of approximately between 200 MHz and 400 MHz. In order to avoid interfering with other devices which operate in this frequency range, such as garage door openers, the airborne signal can be transmitted for only a short interval of time, such as for less than 15 seconds within any one hour time interval. Heater wires 14 and 48 can continue to operate for up to approximately 1.5 hours after the termination of the air-borne signal.

When antenna 44 of receiver 40 receives the airborne signal, a signal is transmitted from receiver 40 to controller 36 on line 88, indicating that the airborne signal has been received. As indicated in FIG. 4, the airborne signal is transmitted from the outside of building 70 through roof 58 and to the inside of building 70, i.e., to antenna 44, receiver 40 and controller 36. Upon receiving the signal on line 88, controller 36 interconnects power supply 38 with one or more of heaters 14. The operation of heaters 14 can be dependent upon the operation of heaters 48. For instance, heaters 14 can be operated for a longer period of time than are heaters 48.

The heat from heaters 14 is dispersed by heat conduction device 12 throughout the entire body portion 16. The heat within body portion 16 is then transferred by conduction to inside surface 56. The heat then conducts to roof 58 and to its outside surface 68. As outside surface 68 heats up, it melts any ice or snow which falls or has accumulated thereon. The melted snow and ice then drains into gutter 78 and flows down downspout 80. Controllers 36 and 52 can shut off heaters 14 and 48, respectively, after respective periods of time after the start of operation. For example, controller 36 can stop operation of heaters 14 after approximately 1 hour.

Heater wire 14 has been shown as being attached to either first side 26 or second side 28 of body portion 16. However, it is to be understood that heater wire 14 can also be embedded within body portion 16.

Side portions 18 and wings 20 have been shown as being formed of a thermally conductive material. However, it is to be understood that sides 18 and wings 20 can also be formed of a non-thermally conductive material in order to avoid conducting heat away from inside surface 56 of roof 58. Alternatively, it is possible to place a layer of thermally insulative material between rafters 60 and side portions 18 and/or wings 20.

Wings 20 have been shown as being attached to an inside surface of a rafter 60, i.e., to a, surface facing the inside of building 70. However, it is to be understood that it is possible for heat conduction device 12 be a planar, unbent sheet, with wings attached to respective outside surfaces of rafters 60, i.e., to surfaces facing and possibly in contact with roof 58.

Controller 52 has been described as being located on outside surface 68 of roof 58. However, it is also possible for the heating apparatus to be controlled by a single controller located within building 70. The single controller could be hard wired to a moisture and/or temperature sensor located outside building 70.

Figure 6:
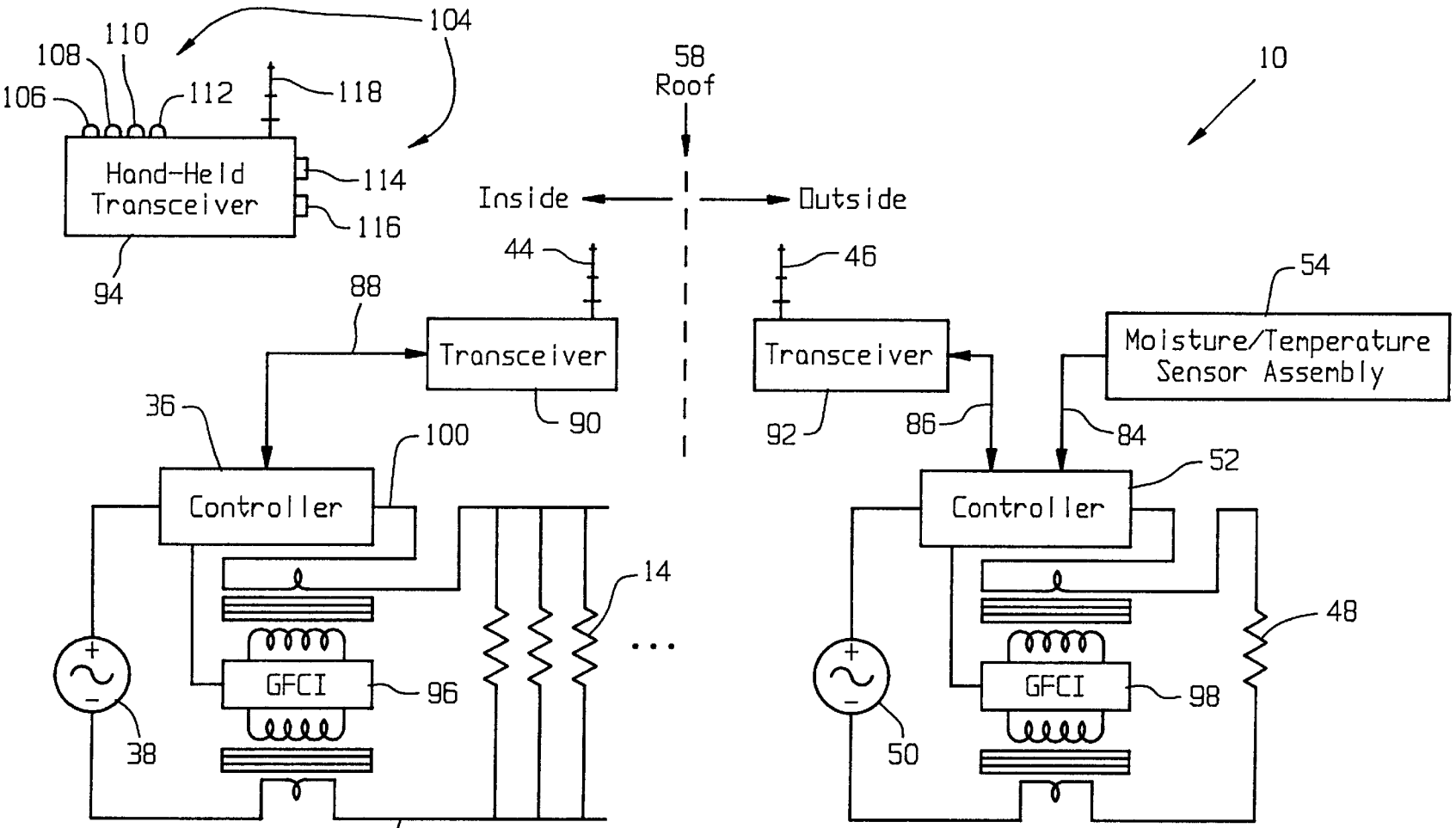
FIG. 6 is a schematic diagram of another embodiment of the snow melting apparatus of FIG. 3.

In yet another embodiment (FIG. 6), transceivers 90 and 92 respectively perform all of the functions of receiver 40 and transmitter 42 described above, and also perform additional functions which are described in detail below. More particularly, a hand-held transceiver 94 allows a user to send and receive information from each of heater transceivers 90 and 92.

A ground fault circuit interrupter (GFCI) 96 is coupled across heater wire 14 and is connected to controller 36. Another GFCI 98 is coupled across heater wire 48 and is connected to controller 52. GFCI 96 detects ground fault conditions by comparing a line current in conductor 100 to a neutral current in conductor 102. If the difference between the two currents exceeds 30 milliamperes, GFCI 96 instructs controller 36 to prevent current from flowing through conductor 100. Controller 36 then sends a signal on line 88 instructing transceiver 90 to transmit a radio frequency ground fault signal indicating the presence of a ground fault condition. Once GFCI 96 has been tripped, GFCI 96 must be reset in order to cancel GFCI operation and allow power to be reapplied to heaters 14.

Hand-held transceiver 94 has a user interface 104 including lamps 106, 108, 110, 112 and pushbuttons 114 and 116. Hand-held transceiver 94 receives the signal generated by transceiver 90, indicating that a ground fault has occurred, and illuminates lamp 106 in order to provide a visible indication to the user that attention is required. Upon seeing that lamp 106 has been illuminated, the user may then actuate reset button 114. Transceiver 94 transmits a radio frequency reset command signal via antenna 118 in response to actuation of reset button 114. Transceiver 90 receives the reset command signal and relays it to controller 36, which then resets GFCI 96.

A user may initiate a test of GFCI 96 by actuating test button 116. Transceiver 94 transmits a radio frequency test command signal via antenna 118 in response to actuation of test button 116. Transceiver 90 receives the test command signal and relays it to controller 36, which, then tests GFCI 96. Controller 36 can perform the test by closing a switch (not shown) which provides an alternate current path in parallel to conductor 102. This alternate current path reduces the current through conductor 102 and thereby simulates a ground fault condition. Upon sensing the reduced current in conductor 102, GFCI 96 trips and prevents further current flow in conductor 100. After seeing that lamp 106 has been illuminated, indicating that GFCI 96 has operated properly, the user can actuate reset button 114 in order to reset GFCI 96 as described above.

Controller 36 also generates a heater status signal through transceiver 90 indicating that current is being carried by conductor 100 and that heater 14 is operating. Hand-held transceiver 94 receives this operational status signal and illuminates lamp 108 in response thereto. The illumination of lamp 108 is an indication to the user that heater 14 is operating. Transceiver 90 must continuously receive either the reset command signal or the test command signal for a predetermined period of time, such as between 2 seconds and 7 seconds, before controller 36 responds thereto. This delay prevents extraneous, transient radio frequency signals received by transceiver 90, such as from automatic garage door openers, for example, from being incorrectly interpreted as command signals from transceiver 94. Preferably, the predetermined period of time can be approximately 5 seconds.

The operation of transceiver 92, controller 52 and GFCI 98 are substantially similar to the operation of transceiver 90, controller 36 and GFCI 96, respectively, as described above with relation to FIG. 6. Thus, the operation of transceiver 92, controller 52 and GFCI 98 will not be described in detail herein. The operation of lamps 110 and 112 in response to transceiver 92 is also substantially similar to the operation of lamps 106 and 108 in response to transceiver 90, and will not be described in detail herein.

In order to discriminate between which of transceiver 90 and transceiver 92 is to receive a command signal transmitted by transceiver 94, the command signal is transmitted with a power level sufficient to be received by only a closer one of transceivers 90 and 92. Transceivers 90 and 92 are physically displaced from one another by a distance that is large enough to facilitate such discrimination. The user physically carries hand-held transceiver 94 to an area in proximity to the selected one of transceivers 90 and 92 that is to be addressed. The user then manipulates user interface 104 as described above in order to transmit a command signal. The command signal is then received by the one of transceivers 90, 92 that is closer to transceiver 94. However, the command signal is not received by the one of transceivers 90, 92 that is further from transceiver 94. Similarly, the ground fault signals and heater status signals may be transmitted by transceivers 90 and 92 with a low level of power such that they can be received by only a relatively nearby hand-held receiver 94.

Alternatively, each of the ground fault signal and heater status signal can include address information to identify from which of transceivers 90 and 92 that the signals originate. Similarly, the command signals transmitted by transmitter 94 can include address information to identify which of transceivers 90 and 92 is to receive and respond to the command signals.

The frequencies of the ground fault signal, heater status signal, and command signals are in the range of 300 MHz to 900 MHz. However, it is also possible for these signals to be infrared signals or to be carried on wire conductors. Further, the signals may be transmitted between transceivers 90, 92 and 94 via carrier current on the alternating current power lines.

Hand-held transceiver 94 has been described herein as having visual indicators in the form of lamps 106, 108, 110 and 112. However, it is also possible for transceiver 94 to have audible indicators, such as beepers, to perform the functions of lamps 106, 108, 110 and 112.

The present invention has been described as having only one controller 36 disposed under roof 58. However, it is also possible to include multiple controllers 36 under roof 58, with each controller 36 having a respective transceiver 90, GFCI 96 and heater 14. In this case, hand-held transceiver 94 would communicate with each transceiver 90 separately. Further, the methods by which transceiver 94 would identify which of transceivers 90 was sending or receiving information would be substantially similar to the methods described above with regard to transceiver 94 discriminating between transceiver 90 and transceiver 92.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of preventing ice dams on an outside surface of a roof of a building, said method comprising the steps of:

placing a heating device below the roof;

sensing at least one of an ambient outside temperature and a presence of ambient moisture;

transmitting an air-borne signal dependent upon said sensing step; and operating said heating device dependent upon said air-borne signal.

2. The method of claim 1, wherein said sensing step is performed by a sensor device disposed outside of the building, said method comprising the further steps of:

connecting a transmitter to said sensor, said transmitter being disposed outside of the building;

transmitting said air-borne signal with said transmitter;

connecting a receiver to said heating device, said receiver being disposed inside of the building; and receiving said air-bore signal with said receiver.

3. The method of claim 1, wherein said air-borne signal comprises a radio frequency signal.

4. The method of claim 3, wherein said radio frequency signal has a frequency of approximately between 200 MHz and 400 MHz.

5. The method of claim 1, wherein said air-borne signal is transmitted for a duration of less than one minute during any one hour time interval.

6. The method of claim 5, wherein said air-borne signal is transmitted for a duration of less than 15 seconds during any one hour time interval.

7. The method of claim 5, wherein said heating device is operated for a duration of at least one hour in response to said air-borne signal.

8. The method of claim 1, comprising the further steps of:

placing an outside heater outside of the building; and selectively controlling operation of said outside heater dependent upon said sensing step.

9. The method of claim 8, wherein said outside heater is disposed in at least one of a gutter and a downspout.

10. The method of claim 8, wherein said operating of said heating device is dependent upon said operation of said outside heater.

11. The method of claim 10, wherein said heating device is operated for a longer time period than is said outside heater.

* * * * *

UNITED STATES PATENT AND TRADEMARK OFFICE

CERTIFICATE OF CORRECTION

PATENT NO. : 6,297,475 B2
DATED : October 2, 2001
INVENTOR(S) : Thaddeus M. Jones It is certified that error appears in the above-identified patent and that said Letters Patent is hereby corrected as shown below:

Title page,
Item [60], Related U.S. Application Data, delete "09/342,493" and substitute -- 09/542,493 -- therefor.

Column 1,
Line 9, delete "6,219,102", and substitute -- 6,215,102 -- therefor.

Column 3,
Line 14, delete "ac&cross-sectional", and substitute -- a cross-sectional -- therefor.

Signed and Sealed this

Fifteenth Day of April, 2003

JAMES E. ROGAN
*Director of the United States Patent and Trademark Office*